US006343453B1

(12) United States Patent
Wright

(10) Patent No.: US 6,343,453 B1
(45) Date of Patent: Feb. 5, 2002

(54) COMPOSITE WOODEN BEAM AND METHOD FOR PRODUCING SAID BEAM

(76) Inventor: Jerauld George Wright, 10, Wren Road, Gloucester, Ontario (CA), K1J 7H4

( * ) Notice: Subject to any disclaimer, the term of this patent is extended or adjusted under 35 U.S.C. 154(b) by 0 days.

(21) Appl. No.: 09/500,235

(22) Filed: Feb. 8, 2000

(30) Foreign Application Priority Data

Feb. 12, 1999 (CA) ..... 2261526

(51) Int. Cl.[7] ..... E04C 3/12

(52) U.S. Cl. ..... 52/729.4; 52/729.1; 52/730.6; 52/730.7

(58) Field of Search ..... 52/729.4, 729.1, 52/730.6, 730.7, 729.2

(56) References Cited

U.S. PATENT DOCUMENTS

| | | | | | |
|---|---|---|---|---|---|
| 2,426,943 | A | * | 9/1947 | Morden | 20/4 |
| 4,191,000 | A | | 3/1980 | Henderson | 52/729 |
| 4,413,459 | A | | 11/1983 | Lambuth | 52/729 |
| 4,458,465 | A | | 7/1984 | Coe | 52/729 |
| 4,715,162 | A | | 12/1987 | Brightwell | 52/729 |
| 4,967,534 | A | * | 11/1990 | Lines | 52/729 |
| 5,267,425 | A | | 12/1993 | Onysko et al. | 52/729 |
| 5,323,584 | A | | 6/1994 | Scarlett | 52/729 |
| 5,901,524 | A | * | 5/1999 | Wright | 52/668 |
| 6,025,053 | A | * | 2/2000 | Grenier | 428/172 |

FOREIGN PATENT DOCUMENTS

| | | |
|---|---|---|
| CA | 433984 | 4/1948 |
| CA | 1224907 | 8/1987 |

* cited by examiner

*Primary Examiner*—Beth A. Stephan
*Assistant Examiner*—Patrick J. Chavez
(74) *Attorney, Agent, or Firm*—Jones, Tullar & Cooper, PC

(57) ABSTRACT

A wooden I beam comprising upper and lower wooden members each having an outer longitudinal flange secured by glue to an elongated web, upper members of the beam being connected at end joints which are staggered relative to end joints between lower members of the beam, the webs of all members being inwardly projecting and connected together by means including non-metallic pegs or bolts fitting into aligned bores in the webs and/or members connecting said webs. The beam can be produced by continually connecting additional upper members and lower members to one end of the beam, each upper member having its web connected to the web of a lower member already incorporated in the beam, and vice versa. Required lengths of the beam are continually sawn off from the other end of the beam as it is produced.

18 Claims, 2 Drawing Sheets

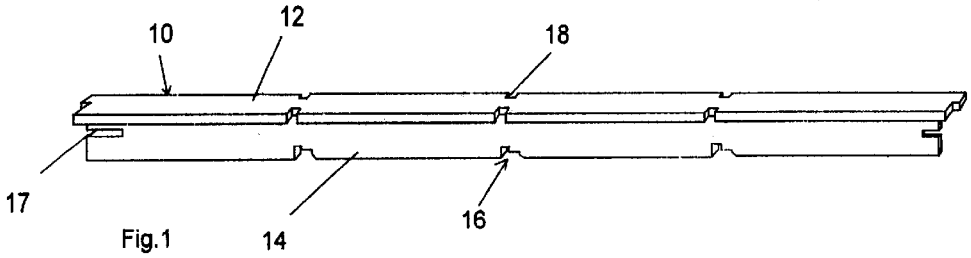
Fig.1
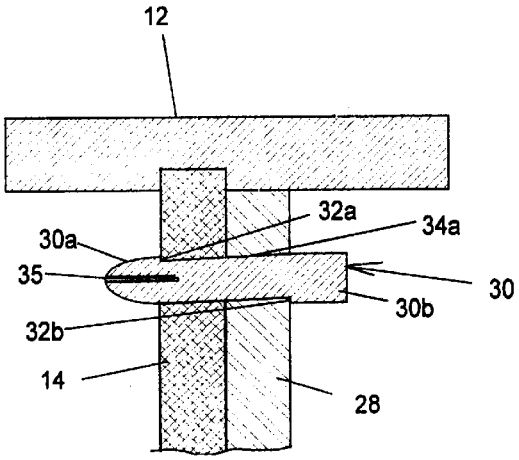
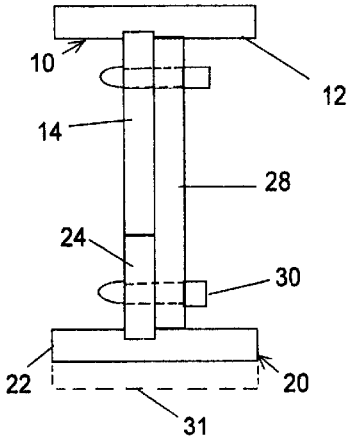
Fig.2
Fig.4
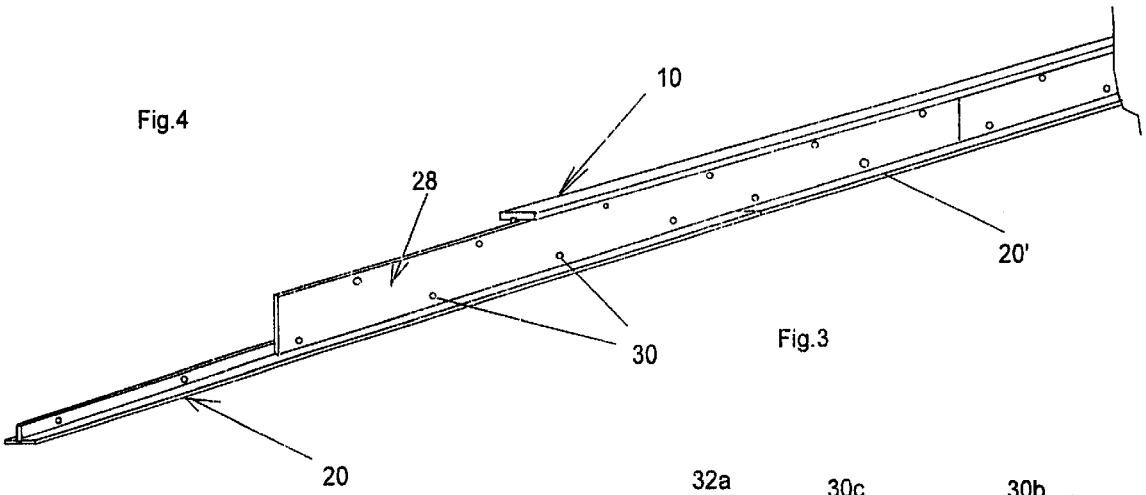
Fig.3
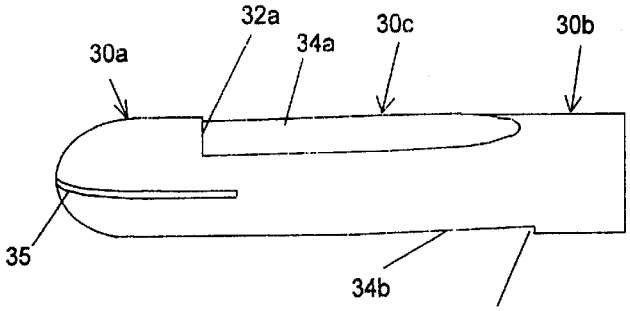
Fig.5

COMPOSITE WOODEN BEAM AND METHOD FOR PRODUCING SAID BEAM

BACKGROUND OF THE INVENTION

1. Field of the Invention

The present invention relates to composite beams or similar members, e.g. posts, formed from wooden members, and especially composite I beams.

2. Prior Art

In recent years the increasing scarcity and cost of large trees suitable for wooden joists or beams has lead to the use of composite beams, such as I beams, in which the upper and lower flanges of the beams, and the web member, are formed as separate pieces and then joined together. While in the past such beams were sometimes made of wooden pieces held together with bolts, in modern composite beams the flanges are nearly always joined to the web members by adhesive. Examples of composite beams using adhesive are shown in the following patents:

U. S. Pat. No. 4,191,000, issued Mar. 4,1980 to Henderson;

U. S. Pat. No. 4,413,459, issued Nov. 8,1983 to Lambuth;

U. S. Pat. No. 4,458,465, issued Jul. 10,1984 to Coe;

U. S. Pat. No. 4,967,534, issued Nov. 6,1990 to Lines;

U. S. Pat. No. 4,715,162, issued Dec. 29,1987 to Brightwell;

U. S. Pat. No. 5,267,425, issued Dec. 7,1993 to onysko et al., and

U. S. Pat. No. 5,323,584, issued Jun. 28,1994 to Scarlett.

The joints between the flanges and webs of such composite beams are critical to the strength of the beam, and this means that glued joints need to be made under factory conditions where presses can apply proper pressure to the joints while they set. Accordingly it is almost universal for these beams to be made in factories which are often at a large distance from the location where they will be used. The beams are usually transported in lengths of say 40 or 50 feet, and are cut into shorter lengths at a building supply depot near to the building site.

There is considerable wastage in producing and using composite beams in this way, due to the fact that builders need many different beam lengths. Typically, builders will have lengths of say 10 to 18 feet cut off from the 40 or 50 foot length, and usually this will leave short lengths which are unsaleable. This wastage contributes to the fairly high cost of these beams. The present invention allows a many different lengths of composite beam to be produced with negligible wastage.

The term "beam" as used herein will be understood to refer not only to members used horizontally under floors or roofs, but also to members which may be used vertically, in the manner of posts or as vertical strengthening members used in walls.

The method of this invention can make use of T-shaped members used for forming building panels of the type described in my pending Canadian Patent Application No. 2,245,299, filed Aug. 19,1998 (corresponding to issued U. S. Pat. No. 5,901,524, issued May 11, 1999). This pending application describes several designs of T-shaped members formed from strips of material such as OSB (oriented strand board) material having flanges and webs with specially designed notches which allow the members to be readily assembled into building panels by unskilled labor. Normally, such members are 8 feet in length, and produce 8 foot square panels. The right angle joints between the webs and flanges of these members are dado joints which are strongly glued using suitable presses in factories where the notches are also cut.

A primary use of such panels is in walls, but my aforesaid copending application also describes how such panels can be connected in overlapping relationship to provide floor panels bridging widths greater than 8 feet. While these methods can provide suitable strength, there is the problem that panels connected together like this are heavy and difficult to manipulate. The present invention allows the T-shaped members which are the same or similar to those described in my pending application to be assembled into I beams which are quite light and easy to handle, and which can be used to support the panels of my pending application. Where stresses are low, the T-shaped members can be identical to the notched members of my pending application, but for higher loads it is preferred to use members which are closely similar to those of my pending application but which do not have the notches.

SUMMARY OF THE INVENTION

I have realized that the wastage involved in present production of composite I beams can largely be eliminated by producing the beams at a place of assembly or workshop near to a building site, in a manner which allows a continuous length of beam to be produced by continually adding pieces, including T-shaped members, to one end, while the required beam lengths are continually cut off from the other end. To avoid the problems with making satisfactory glued joints on site, the only such joints are the factory made joints between the flanges and the webs of the T-shaped members, and these members and any other pieces of the beams are connected together with mechanical connecting means, preferably non-metallic fastening means such as wooden pegs or bolts. The term "mechanical connecting means" is intended to exclude glue. While non-metallic connecting means have the advantage that they can be sawn through without difficulty, metallic means such as nails may be used if these are such as to be removable before sawing.

More specifically, the present invention provides a process for producing varying lengths of composite wooden beams with minimal waste, in which the beams are formed from upper and lower wooden members of predetermined length each member having a longitudinal flange securely joined at a right angle to an elongated web, with the web of each upper member being connected to the web of a lower member, the process comprising:

forming a continuous beam by continually connecting additional of said members to one end of a beam portion formed of members already connected together, each additional upper member having its web connected to the web of a lower member already incorporated into the beam and each additional lower member having its web connected to the web of an upper member already incorporated into the beam, and so that the ends of upper members abut each other at joints which are staggered from similar joints between the ends of lower members, all of the webs being connected together by mechanical connecting means, and continually cutting off required lengths of the assembled beam measured from an end of the beam portion opposite to said one end.

The reference to "upper" and "lower" members will be understood in relation to the normal orientation these parts in a horizontal beam as produced, and does not imply that the process needs to be done in any particular orientation. The reference to the ends of the members abutting does not preclude the possibility that these ends may be separated for example by shims inserted to avoid looseness at these joints.

The mechanical connecting means between the webs may be pegs or like means, such as bolts, inserted through the adjacent webs of the upper and lower members to directly connect the webs. Alternatively, instead of a direct connection between the webs of upper and lower members, the mechanical connecting means may include additional web connecting members lying in face-to face relationship with the webs of both the upper and lower members and connected thereto by pegs or like means, the end joints between the web connecting members being staggered between the joints of the upper and lower members. The web connecting members may correspond to the flanges of further, intermediate T-shaped members generally similar to either the upper or the lower members.

Where pegs are used, these may each have a front end portion terminating in a rearwardly facing abutment surface, and a rear end portion which is wider than the diameter of the aligned bores in the web and/or web connecting members. The rear end portion may terminate in a forwardly facing abutment surface, the two abutment surfaces of the peg locating against the sides of parts held by the peg. Alternatively, the peg may have rearwardly and outwardly diverging side surfaces, and the rear end portion may be merely a wide and diverging end portion of the peg which is capable of firmly pressing against the outer side of one of the connected members, so that each member is held between the wide rear end of a peg and its rearwardly facing abutment surface. Wooden or plastic pegs are preferred, and allow the beams to be produced without metallic parts so that they can be cut by saws without danger of damage to blades.

Where bolts are used, these are also preferably non-metallic; suitable bolts may be formed by cutting threads on ¾ inch diameter wooden dowels. Wooden nuts for such bolts may be made from OSB material.

The T-shaped members used in this method are preferably similar to those of my pending application in having a strong dado joint between the flange and the web which is glued under pressure in a factory. This factory may produce both the notched members of my pending application, and notched or non-notched members, in similar or longer lengths, for producing the beams. The production method as a whole may therefore be considered as including the production of the T-shaped members as a first step by gluing together strips forming the flange and web of each member, and transporting the members to a place of assembly convenient to the building site, where the beams are produced by the method described. Assembly begins with connecting together the webs of two of the members, so that a beam portion is produced having an upper and a lower member, the flanges being spaced apart by the webs, or by web connecting members if used, and then continually adding further members to the one end of the beam portion as described.

The beam produced by the process of this invention comprises upper and lower members each member having an outer longitudinal flange secured by glue at a right angle to an elongated web, upper members of the beam being connected at end joints which are staggered relative to end joints between lower members of the beam, the webs of all members being inwardly projecting and connected together by means including mechanical fastening means such as pegs or bolts, or in some cases nails, connecting the webs. Preferably, the fastening means are non-metallic and capable of being sawn through when the beams are sawn. However, nails can be used as fastening means, if used in such a way as to be easily removed before cutting a beam.

BRIEF DESCRIPTION OF THE DRAWINGS

Preferred embodiments of the invention will now be described by way of example with reference to the accompanying drawings, in which;

FIG. 1 is a perspective view of a notched T-shaped member of the kind used in my aforesaid pending application, and which can be adapted for forming I beams in accordance with this invention;

FIG. 2 is an end view of a simple form of beam made in accordance with this invention;

FIG. 3 is a perspective view of an end portion of the beam of FIG. 2 being formed by the method of this invention;

FIG. 4 is an enlarged cross-sectional view through parts joined by a wooden peg;

FIG. 5 shows a perspective view of the peg of FIG. 4;

DETAILED DESCRIPTION

Figure 6:
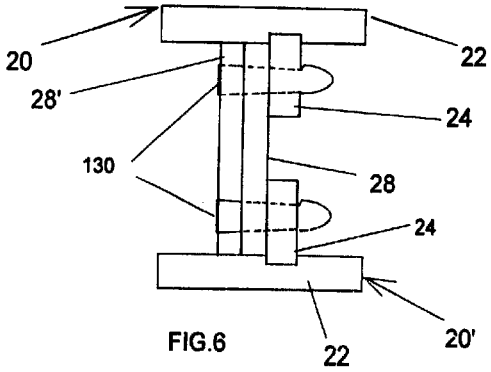
FIG. 6 shows an end view of a further form of beam.

FIG. 1 shows a T-shaped member 10 similar to one of the members of my aforesaid copending application. This member is approximately 8 feet in length, and is preferably made from OSB of ¾ inch thickness. It has an upper flange 12 of 4 inches width connected by a dado joint to a web 14 which projects 4 inches from the flange giving the member an overall height of 4¾ inches. The dado joint is a strong factory glued joint, as described above. The web 14 has transverse notches 16 and end notches 17, while the flange 12 has side notches 18. All these notches are provided to allow the use of the member in making panels as described in my pending application, and are not relevant or needed for the present invention. However, where it is desired that a house be built with a minimum number of different pieces, these notched members can be used to make beams in accordance with the present invention, provided that the building design takes account of the weakening effect of the notches.

FIGS. 2 and 3 show one form of beam in accordance with this invention, made up from primary members similar to member 10, although preferably without notches, and secondary members 20, also described in my copending application, which are similar to members 10, having the same flanges 22, but having narrower webs 24. As shown, these latter webs project only 2 inches from the flange, giving an overall depth of 2¾ inches.

In FIG. 2, the webs 14 and 24 are joined by web connecting members 28 which are overlapped with the webs 14 and 24 and secured to these webs by wooden pegs 30, discussed below with reference to FIGS. 4 and 5. In the example shown, the web connecting members 28 each have a thickness of ½ inch, a length of 8 feet, and a width such that the outer edges of the opposed web members 14, 24 can be butted together while the members 28 fit between the insides of the flanges 10 and 20. As described in my copending application, the webs 14 and 24 are not centered on the flanges, but each has one side which is at the centerline of the flange; this arrangement allows the webs and connecting members 28 to meet at the vertical center of the beam. The joints between the ends of the members 10, 20 and 28 are staggered, as will be explained below with reference to FIG. 3.

The strength of the beam shown in FIGS. 2 and 3 can be materially improved by the addition of plain wood planks indicated by broken lines 31, these also being 8 feet in length, and being butted end to end and held, as by further pegs 30 (not shown), to the bottom of the flange 22, the joints between the planks 31 being staggered between those connecting the ends of adjacent members 20. This is especially valuable if the flange 22 is notched, but such additional members also help to prevent separation of the joints between the flanges of adjacent members 20.

The use of wooden pegs 30 allows the beam to be produced without any metal parts so that after assembly it can be sawn through at any location without danger of damaging the saw. Pegs of plastic material could be used with the same advantage. It is not essential, however, to avoid steel connecting means such as bolts, provided that due care is taken to cut between these.

FIGS. 4 and 5 show details of the wooden pegs 30 as used in the constructions of FIGS. 2 and 3. As shown, these have a generally cylindrical body with a front end portion 30*a* which, in use, passes completely through the aligned bores of the overlapped parts, a rear end portion 30*b* which remains projecting when the peg is in place, and an intermediate portion 30c which is enclosed within the aligned bores when the peg is in place. To ease the entry of the peg into aligned bores, which are preferably slightly smaller in diameter than the diameter of the cylindrical portions of the peg, the front end portion has a rounded nose, and a transverse slit 35 extends across and along the length of the front end portion and into the intermediate portion; this allows compression of this front end portion during insertion.

The rear of the front end portion 30*a* is defined by a rearwardly facing, generally radial abutment surface 32*a* formed, as by a saw cut, in a top portion of the peg, while the front of the rear end portion 30*b* is defined by a similar forwardly facing abutment surface 32*b*. The intermediate portion 30*c* of the peg is defined by a continuation of the cylindrical sides of the body, and by upper and lower flat sloping surfaces 34*a* and 34*b*. Specifically, the upper surface 34*a* slopes radially inwardly from a cylindrical upper surface of the rear portion 30*b* down to meet an inner extremity or base of the first abutment 32*a*, and the lower surface 34*b* slopes radially inwardly from a cylindrical lower surface of the front portion 30*a* to meet an inner extremity or base of the second abutment 32*b*, the upper and lower surfaces 34*a* and 34*b* being parallel.

FIG. 4 shows how the peg 30 fits into two aligned bores in overlapping members 14 and 28, into which it has been driven by a mallet or hydraulic press. The aligned bores are ⅝ inch diameter, slightly smaller than the ¾ diameter dowel stock from which the peg is made. The nose portion has been pushed through the aligned bores, being compressed as allowed by the slit 35, and the peg has been stopped in its movement when the abutment 32*b* strikes the outer surface of the member 28, at which stage the nose portion has expanded as the abutment 32*a* reached the outer surface of member 14. The members 14 and 28 are thus held in contact between the two abutments 32*a* and 32*b*.

The fact that the basic diameter of the cylindrical portion of the peg is slightly larger, by say ⅛ inch, than the diameter of the bores, ensures a very tight fit. This is possible without splitting the wood because the members 14, 24 and 28 are of OSB or similar material, having randomly oriented strands, which is highly resistant to splitting.

FIG. 3 illustrates the method of the invention being used in the production of the basic FIG. 2 beams (i.e. without the planks 31), and illustrates the overlapping relationship of the beam components. The left hand end portion of the composite beam being produced has an upper member 10, a web connecting member 28 overlapped to project about 32 inches from the end of the member 10, and a lower member 20 overlapped to project about 32 inches from the end of similar member 20'. Each member is 8 feet in length, so this arrangement means that about 32 inches separates all of the joints of the beam. The members are held together by pegs 30 as shown in FIG. 3 at 16 inch centers, the pegs also being staggered as between top and bottom. To further extend the beam, additional members 10, 28 and 20 are continually added to the left hand end of the beam portion shown, the inner end of each member being butted up against the end of the preceding similar member, and each added member being secured in place at points where the members overlap. This is a procedure which can easily be done manually, or with simple tools such as a hydraulic press to push the pegs into place, to produce a beam of indefinite length. The final beams have adequate strength by reason of the overlapping nature of the joints and by reason of the strong glued joints between the flanges and webs.

The bores for the pegs 30 may be pre-drilled at suitable spacing, e.g. 16 inches spacing. However, there may be difficulty with obtaining sufficiently accurate alignment with pre-drilled holes, so it is preferred to drill the holes through the overlapping members during the assembly. The preferred arrangement is to provide, in the webs 24, small (for example ⅛ inch diameter) holes, which may be only partially drilled (i.e. blind holes), and to use these as guides to drill the actual large holes for the pegs through both the webs 24 and the web connecting members 28, while keeping the parts clamped so that the edges of the web connecting members are maintained in firm contact with the flanges 22.

The beam portion is continually extended by addition of further members at the left hand end in accordance with the need for lengths of the beam which are cut off, by a saw, from the right hand end. Preferably, the cuts are made between the pegs, but the use of wooden pegs means that a saw will not be harmed by cutting through such pegs. If necessary, additional pegs, or screws, may be added at the cutting stage, to ensure that the members are properly connected near to the cut off ends.

Thus, composite beams can be produced by this method in a simple workshop near to a building site, without special equipment, in a large variety of lengths, with practically no wastage or unusable pieces.

FIGS. 6–9 show various other forms of beam which can be made in accordance with this invention, all making use of primary and/or secondary members as described above, and additional reinforcing wooden strips. These embodiments make use of a modified form of wooden peg 130, which has the advantage that it is not tie d to a specific dimension for the combined thickness of the connected members, and in fact may be used for connecting either two or three thicknesses of wood together.

FIG. 6 shows a joist formed of two secondary members 20 and 20', and two web connecting members 28 and 28', of 4 inch width and ½ inch thickness which connect the webs 24 of the secondary members. The joints between these members are staggered as before, and overlapping portions of the members are held together by pegs 130, shown in detail in FIG. 7.

Figure 7:
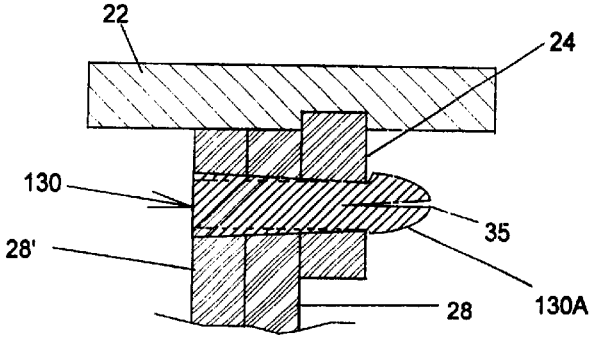
FIG. 7 is an enlarged sectioned view of the peg used in the FIG. 6 construction and associated parts.

As shown in FIG. 7, the peg 130 has a front end portion 130*a* similar to that of the peg 30, having a rounded front end with a transverse slit 3s allowing it to be compressed for entry into the aligned bores of webs 24 and connecting members 28, 28', which are the same diameter before being expanded by having the peg driven in. To the immediate rear of the front end portion the diameter of the peg is substantially the same as, or just slightly smaller than, the aligned bores, and from here the peg diverges gradually towards its rear end. For aligned bores initially of ⅝ inch, the divergence is such that the rear end has a diameter of ¾ inch. This characteristic of the peg is useful in allowing it to be used both for holding together two thicknesses of wooden members, as will be described in relation to FIG. 8, as well as when holding three thicknesses together as shown in FIG. 7. The aligned bores are all initially ⅝ inch, but when the peg is being driven in the bores in the members 28 and 28', especially the latter, expand to accommodate the peg. Provided OSB or similar material is used, this does not cause substantial splitting.

Figure 8:
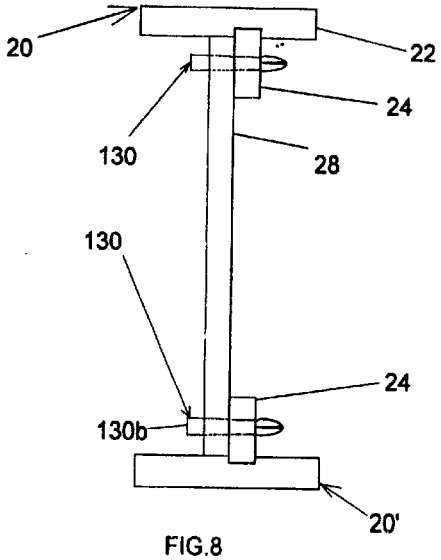
FIGS. 8 and 9 are further end views of alternative beams made in accordance with the invention.

FIG. 8 shows a variation of the FIG. 6 construction with a much deeper web formed by web connecting member 28 connected by pegs 130 to webs 24 of members 20 and 20'. Here, rear end portions 130*b* of the pegs remain outside the connected members; these rear end portions, being of substantially larger diameter than the aligned bores, are effective t o hold the member 28 pressed against the webs 24; in other words these act similarly to the rear end portions of the pegs of FIGS. 2 and 4.

It will evident from FIGS. 6 and 8 that beams of widely varying depth can be produced from a series of the primary or secondary members 10 and 20, along with web connecting members 28 of varying width which can readily be cut on site depending on the depth of beam required. Accordingly a preferred process of the invention includes the on-site cutting of strips from sheet material to form the web connecting members 28, the sheet material being for example OSB material of ½ inch thickness, so as to readily produce beams not only of varying lengths but also of varying depths and strengths.

Figure 9:
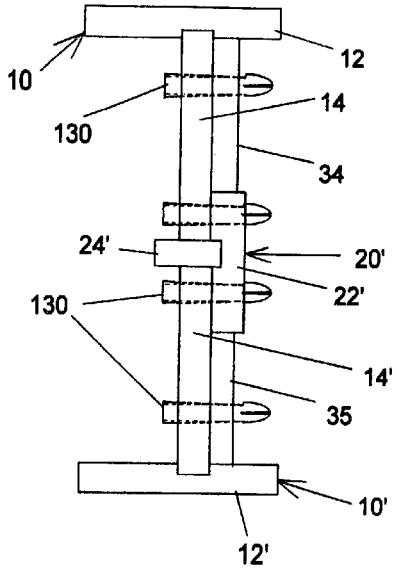

FIG. 9 shows a further embodiment in which primary members 10 and 10' provide both the upper and lower members of the beam, and in which their webs 14 and 14' are coplanar and are connected together by a secondary member 20' having its flange 22' overlying the outer margins of the webs 14 and 14', on first sides of these webs, and having its web 24' trapped between the outer edges of these webs. Wooden planks 34 and 35 of ½ inch thickness are fitted to the first sides of the webs 14 and 14', between the outer edges of the flange 22' and the insides of the flanges 10 and 10', all these parts being held together with pegs 130. This gives a beam of 11¾ inches overall height.

Figure 10:
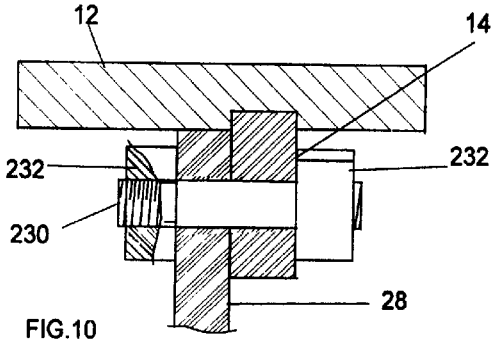
FIG. 10 is a view similar to FIG. 4 showing a wooden bolt as fastening means.

FIG. 10 shows fastening means in the form of a wooden bolt 230, used with two wooden nuts 232, for holding together the webs 24 and web connecting members in a construction similar to that of FIG. 2. The bolt may be formed by cutting screw threads in a ¾ inch dowel, while the nuts 232 may be formed from a 1½ inch square piece of OSB material. A characteristic of this material is that it tends to swell slightly with time, and with moisture, effectively tightening the bolt.

Figure 11:
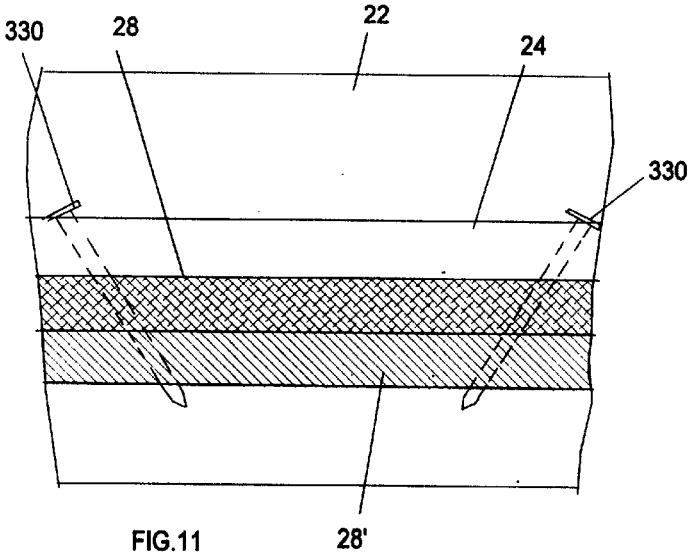
FIG. 11 shows a longitudinal section through the web connecting members of a construction similar to FIG. 6 but using nails as fastening means.

FIG. 11 shows a simple construction, similar to that of FIG. 6, but in which the webs 24 and web connecting members 28, 28' are held together by fastening means in the form of nails 330, which are driven in at angles of about 30 to 40° to the perpendicular to the web and web connecting members, while being in the same, normally horizontal, plane as the flange 22. The adjacent nails are angled oppositely to each other, and are staggered top and bottom. When it is desired to cut through a beam, nails close to the line of cut must be removed, but normally it will only be necessary to remove one, or at most two, nails for a cut to be made safely. To make them easily removable, the nails are chosen to be long enough that about ½ inch protrudes from the outer web connecting member 28', and this pointed end can be hammered in to enable removal of the nail by its head.

Although FIG. 11 shows nails which are driven from one side only, it may be advantageous to insert the nails alternately from opposite sides of the webs and web connecting members.

I claim:

1. A process for producing varying lengths of wooden I beams with minimal waste, the beams being formed from a series of upper wooden members and a series of lower wooden members each of predetermined length, each upper member having a longitudinal flange secured at a right angle to an elongated upper web by a glued joint and each lower member having a longitudinal flange secured at a right angle to an elongated lower web by a glued joint, with each upper web being connected to a lower web, the process comprising:

forming a continuous beam by continually connecting additional of said members to one end of a beam portion formed of said upper and lower members already connected together, each additional upper member having its upper web connected to the lower web of a lower member already incorporated in the beam and each additional lower member having its lower web connected to the upper web of an upper member already incorporated in the beam and so that the ends of upper members abut each other at joints which are staggered from similar joints between the ends of lower members, each of said upper webs being connected to a lower web by mechanical connecting means and without any glue, and continually cutting off required lengths of the beam from an end portion of the beam opposite to said one end.

2. A process according to claim 1, wherein the mechanical connecting means are non-metallic fastening means inserted through the adjacent webs of the upper and lower members.

3. A process according to claim 1, wherein the mechanical connecting means includes web connecting members connected in face-to-face relationship with the webs of the upper and lower members by fastening means inserted through the webs and web connecting members, the end joints between the web connecting members being staggered between the joints of the upper and lower members.

4. A process for producing varying lengths of composite wooden beams, comprising making a series of T-shaped members of predetermined length by gluing together at right angles strips forming a flange and a web, and transporting said members to a place of assembly, and at said place:

forming a continuous beam by firstly connecting together opposed webs of two of said members, so that a beam portion is produced having an upper member and a lower member, with the flanges of said members being spaced apart by said webs, and by continually connecting additional of said members to one end of said beam portion, each additional upper member having its web connected to the web of a lower member already incorporated in the beam and each additional lower member having its web connected to the web of an upper member already incorporated in the beam and so that the ends of upper members abut each other at joints which are staggered from similar joints between the ends of lower members, all of said webs being connected together by mechanical connecting means in the form of fastening means inserted through the adjacent webs of the upper and lower members, and continually cutting off required lengths of the beam from an end portion of the beam opposite to said one end.

5. A process for producing varying lengths of composite wooden beams, comprising making a series of T-shaped members of predetermined length by gluing together at right angles strips forming a flange and a web, and transporting said members to a place of assembly, and at said place:

forming a continuous beam by firstly connecting together opposed webs of two of said members, so that a beam portion is produced having an upper member and a lower member, with the flanges of said members being spaced apart by said webs, and by continually connecting additional of said members to one end of said beam portion, each additional upper member having its web connected to the web of a lower member already incorporated in the beam and each additional lower member having its web connected to the web of an upper member already incorporated in the beam and so that the ends of upper members abut each other at joints which are staggered from similar joints between the ends of lower members, all of said webs being connected together by mechanical connecting means which includes web connecting members connected in face-to-face relationship with the webs of the upper and lower members and mechanical fastening means forming connections between the webs and web connecting members, the end joints between the web connecting members being staggered between the joints of the upper and lower members; and continually cutting off required lengths of the beam from an end portion of the beam opposite to said one end.

6. A process according to claim 2, wherein the fastening means are non-metallic and are capable of being sawn through when the wooden beams are being cut off, and in which said continuous beam has no metal components.

7. A process according to claim 4, wherein the fastening means are non-metallic and are capable of being sawn through when the wooden beams are being cut off, and in which said continuous beam has no metal components.

8. A process according to claim 3, including the initial step of cutting sheet material into strips to form said web connecting members, the width of said latter members being chosen according to the depth of beam required.

9. A process according to claim 5, including the initial step of cutting sheet material into strips to form said web connecting members, the width of said latter members being chosen according to the depth of beam required.

10. A wooden I beam comprising upper and lower wooden members each member having an outer longitudinal flange secured by glue at a right angle to an elongated web, upper members of the beam being connected at end joints which are staggered relative to end joints between lower members of the beam, the webs of all members being inwardly projecting and connected together by means including mechanical fastening means which secure together said webs without the use of glue.

11. A wooden I beam according to claim 10, wherein said fastening means are non-metallic and are capable of being sawn through when the beams are sawn.

12. A beam according to claim 10, wherein said fastening means are non-metallic pegs, said pegs each having a front end portion terminating in a rearwardly facing abutment surface and a rear end portion which is wider than the aligned bores, said abutment surfaces and rear ends of the pegs tending to hold together face-to-face sides of the webs.

13. A beam according to claim 12, wherein said rear end portions of the pegs each have a forwardly facing abutment surface, and wherein the rearwardly and forwardly facing abutment surfaces of the pegs locate on outer sides of connected webs.

14. A beam according to claim 12, wherein the rear end portions of the pegs are outwardly diverging, said rear end portions being capable of either locating against an outer side of a web, or of being driven into an aligned bore of a reinforcing member laid against said outer side.

15. A beam according to claim 11, wherein the fastening means are non-metallic bolts and nuts carried by said bolts.

16. A beam according to claim 10, which contains no metal components.

17. A beam according to claim 10, wherein said fastening means includes nails which are driven into the webs and which are angled from the perpendicular to said webs.

18. A wooden I beam comprising upper and lower wooden members each member having an outer longitudinal flange secured by glue at a right angle to an elongated web, upper members of the beam being connected at end joints which are staggered relative to end joints between lower members of the beam, the webs of all members being inwardly projecting and connected together by means including mechanical fastening means and web connecting members which connect said webs without the use of glue.

* * * * *